United States Patent [19]

Lamson

[11] Patent Number: 4,926,785

[45] Date of Patent: May 22, 1990

[54] MARKER POST SYSTEM

[75] Inventor: Frederick W. Lamson, Birmingham, Mich.

[73] Assignee: Lockwood Manufacturing Co., Livonia, Mich.

[21] Appl. No.: 409,280

[22] Filed: Sep. 19, 1989

Related U.S. Application Data

[63] Continuation of Ser. No. 229,249, Aug. 8, 1988, abandoned.

[51] Int. Cl.[5] ..... E04H 13/00

[52] U.S. Cl. ..... 116/209; 52/165; 52/298

[58] Field of Search ..... 52/165, 298

[56] References Cited

U.S. PATENT DOCUMENTS

| | | | |
|---|---|---|---|
| 1,668,486 | 5/1928 | Betts | 52/298 |
| 2,775,221 | 12/1956 | Olson | 116/173 |
| 3,174,588 | 3/1965 | Kessler | 52/103 |
| 3,279,133 | 10/1966 | De Korte | 52/103 |
| 3,517,470 | 6/1970 | Luebkeman | 248/156 |
| 4,649,678 | 3/1987 | Lamson | 52/165 |
| 4,738,060 | 4/1988 | Marthaler et al. | 52/103 |

FOREIGN PATENT DOCUMENTS

| | | | |
|---|---|---|---|
| 2322987 | 5/1977 | France | 52/298 |
| 2138527A | 4/1984 | United Kingdom | 285/156 |

*Primary Examiner*—Allan N. Shoap
*Assistant Examiner*—Jeffrey J. Hohenshell
*Attorney, Agent, or Firm*—Krass & Young

[57] ABSTRACT

A marker for golf courses and similar locations including an in-ground receptacle, a surface plate mounted on and in surrounding relationship with the top of the receptacle at ground level, and a tubular "stake" which fits into the receptacle. The plate and receptacle form a swivel bearing to permit the surface plate to lie flush with non-level ground while retaining the vertical orientation of the stake and receptacle. The plate is crowned to shed balls.

17 Claims, 2 Drawing Sheets

MARKER POST SYSTEM

This application is a continuation of Ser. No. 229,249, filed 8/8/88 and now abandoned.

INTRODUCTION

The subject invention comprises a boundary or location marker device of the type including an in-ground receptacle and an above-ground post or stake. The embodiment disclosed is especially adapted to accommodate installation locations where the ground surface is not perfectly level.

BACKGROUND OF THE INVENTION

A variety of boundary or location marker systems have been used to indicate boundaries of golf courses, driveways, cart paths, and pedestrian walkways. Previous boundary marker systems consisted of painted wood or metal stakes driven into the ground. A small decorative chain or rope is sometimes attached to the upper surface of the stake to act as a fence or barrier.

Marker systems are also used on golf courses to define exterior boundaries and lateral hazards. In previous systems marker stakes were not easily removed or if removed were difficult to replace in the original location. Driven marker stakes also present a problem with golf course maintenance as they interfere with moving equipment. As an alternative to removing the stake before mowing the area around the stake may be left uncut or cut by hand. If the stakes are removed and not replaced, nothing exists to indicate the boundary or hazard.

An example of a boundary or location marking system is Pat. No. 4,649,678 disclosing the combination of an in-ground receptacle and a surface plate. A marker stake is inserted into the receptacle to mark the boundary or location. The marker stake is removable for mowing or simply for winter storage. The stake is easily replaced in the proper location using the surface plate as a location indicator. The surface plate also acts as a boundary indicator if the marker stake is not replaced.

The physical relationship between the prior art surface plate and the receptacle is such that the plane of the surface plate is at right angles to the axis of the receptacle; moreover, this relationship is fixed. This can make it difficult to install a surface plate and receptacle combination in an area having a non-level ground surface. One could accommodate the non-level ground surface by making the central aperture of the surface plate much larger than the outer diameter of the receptacle; i.e., size the parts for a very sloppy fit. However, this produces an unsightly gap between the receptacle and the surface plate. This gap adversely affects the appearance of the device and allows grass and weeds to grow around the marker stake and extend upwardly between the plate and receptacle. Moreover, a sloppy, non-contacting fit eliminates the function of the receptacle in holding the surface plate in position.

SUMMARY OF THE INVENTION

Briefly summarized the invention is a system for marking boundaries and locations. In general the system comprises an in-ground receptacle, a surface plate and a removable marker stake which is inserted into the receptacle.

The physical relationship between the surface plate and the receptacle is such that the receptacle holds the surface plate in position, but permits the angle between the plane of the surface plate and the longitudinal axis of the receptacle to be adjusted without the necessity of a sloppy fit and the unsightly gap mentioned above. In the preferred embodiment, the physical relationship is in the form and function of a ball and socket bearing, and allows the plane of the to be adjusted through an angular range, even though the receptacle axis remains vertical.

More specifically, adjustability is provided by complementary internal and external bearing surfaces located on the surface plate and the receptacle respectively. The surface plate, when united with the receptacle, eliminates any unsightly gaps through which weeds or grass may grow. This combination also allows the surface late to remain firmly in place about the receptacle.

The surface plate of the preferred embodiment is circular in shape with a crowned or convex top, allowing golf balls to roll away from the marker stake.

Another aspect of the invention is a hole maker which prepares the ground for installation of the receptacle and plate. As hereinafter described in detail, the hole marker comprises a post having a sharpened point, the depth of which matches the depth of the receptacle, a cutting ring to score or notch the ground surface. The hole maker may also include a footplate spaced upwardly from the sharpened end to permit weight; to be applied to the post.

When used in combination, the hole marker is used to form the holes, allowing the receptacle to be inserted in the ground together with the surface plate, afterwards the marker stake is inserted into the receptacle.

DETAILED DESCRIPTION OF THE SPECIFIC EMBODIMENT

Figure 1:
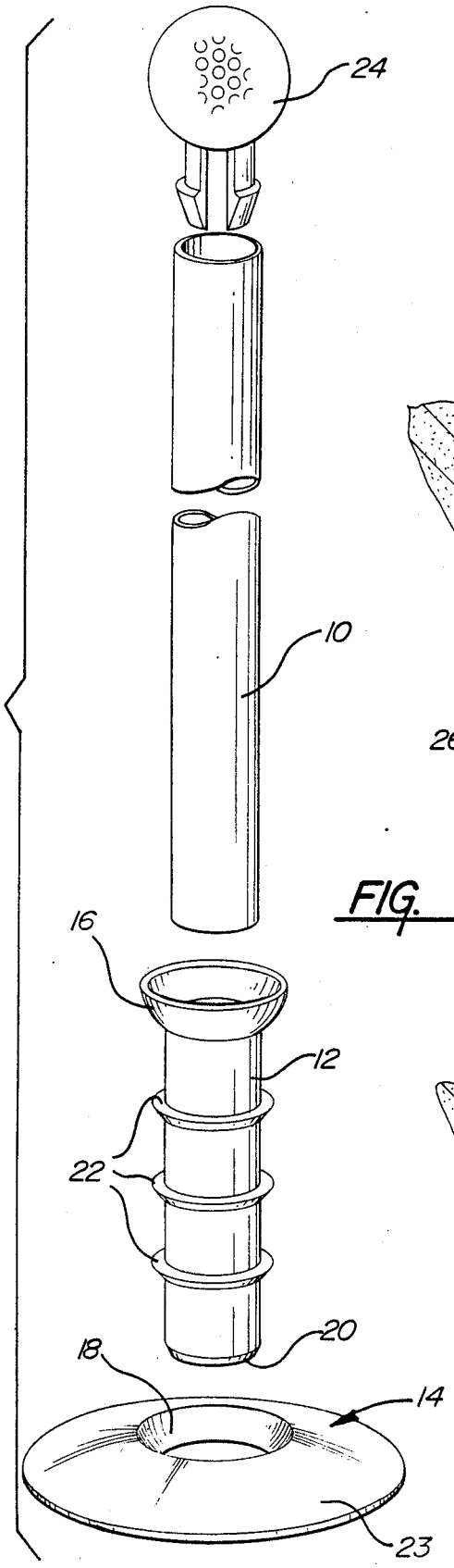
FIG. 1 is an exploded, perspective view of a marker system embodying the invention.

FIG. 1 shows the marker post system to comprise a hollow plastic tubular marker stake 10, a cylindrical plastic receptacle 12, a plastic surface plate 14 and a decorative cap 24 which plugs into the top of the stake 10. The receptacle 12 and surface plate 14 are preferably fabricated from a rigid, weatherproof material such as injection molded plastic. However, the parts may also be made of steel or other long-lasting material. Stake 10 is preferably extruded tubular plastic but may made of various materials including wood.

The receptacle 12 is cylindrical in nature approximately 1 ½ inches in diameter, 6 inches long and ⅛ inch thick; these dimensions being given for the purpose of example. The term "cylindrical" is used as an example herein and it should be noted that this does not necessarily denote a regular and circular cross section as much as it denotes a socket or sleeve-like body. The receptacle 12 can be any cross-sectional shape such as square, octagonal or oblong. Receptacle 12 has open ends. Adjacent the upper end, receptacle 12 has a spherically shaped external flange 16 acting as an external bearing seat for purposes hereinafter described. The lower end 20 of receptacle 12 is beveled to facilitate insertion of the receptacle into the ground. Three spaced annular radially projecting barb rings 22 are formed on the exterior surface of the receptacle 12. The barb rings 22 are continuous with beveled undersurfaces to allow for ease in insertion. The upper surfaces of the rings 22 are planar and perpendicular to the axis of the receptacle 12. The rings 22 act as barbs to inhibit the removal of the receptacle 12 from the ground.

Surface plate 14 is preferably but not necessarily round, approximately 6 inches in diameter and approximately ⅛ inch thick. The surface 23 is crowned or convex. The center of the convex upper surface is approximately ⅝ of an inch above the lower outer edge. The convex or crowned top 23 prevents golf balls from coming to rest next to the marker stake 10; i.e., the plate 14 sheds balls which might otherwise sit on top of the plate. The surface plate 14 exhibits a central aperture defined by an internal semi-spherical bearing seat 18 which cooperates with external bearing seat 16 of receptacle 12 to form a ball and socket type swivel bearing.

A marker stake 10 is inserted into the receptacle 12. The marker stake 10 is extruded tubing approximately 24 inches in length and is of a diameter which will allow it to be easily inserted into and removed from the receptacle. When used as a marking system on a golf course the marker stake 10 is preferably the same color as plate 14, thus indicating the type of boundary even if the marker stake 10 is removed. A decorative a cap 24 can be inserted in the top of the marker stake if desired. The cap 24 may also serve a functional purpose such as a holder for a decorative chain or rope which acts as a fence or barrier.

Figure 2:
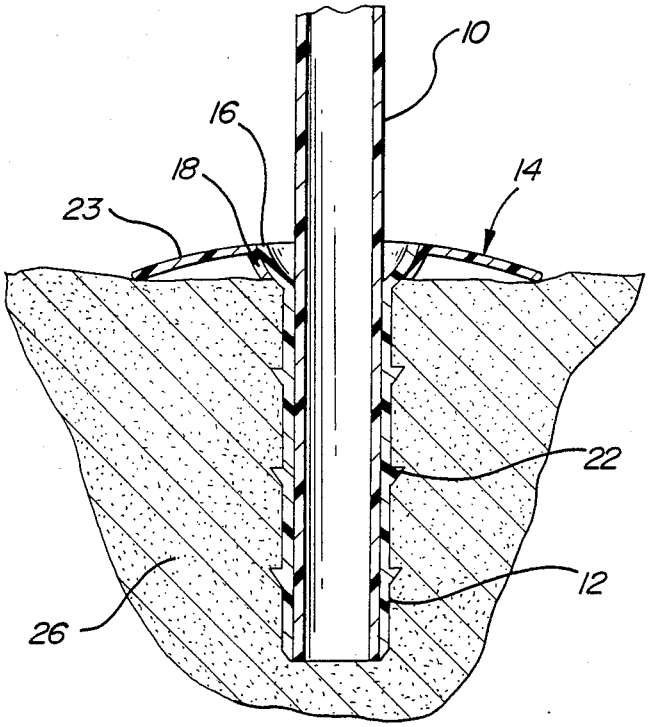
FIG. 2 is a side view of the installed device on a level surface.
Figure 3:
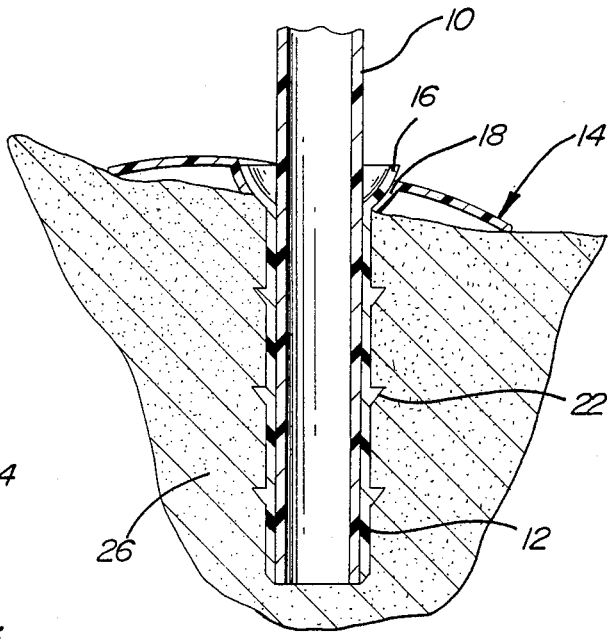
FIG. 3 is a side view of the device installed on a sloped or non-level surface.

FIGS. 2 and 3 show the specific embodiment of the invention, the ability of the surface plate 14 to lie flush on a non-level ground surface when assembled as a unit with the receptacle 12. As shown in FIG. 2, the receptacle 12 is inserted in the ground 26 in a vertical orientation, the surface plate 14 lays flush on the ground surface and the top of the receptacle lays flush with the top of the plate. Marker stake 10 is then inserted in the receptacle 12.

As shown in FIG. 3, when the marker system is installed on a non-level ground surface location, the receptacle 12 is still vertically oriented. The surface plate 14 still lays flush with the ground surface due to the complementary external bearing seat 16 and internal bearing seat 18 allowing for different angular relationships.

Figure 4:
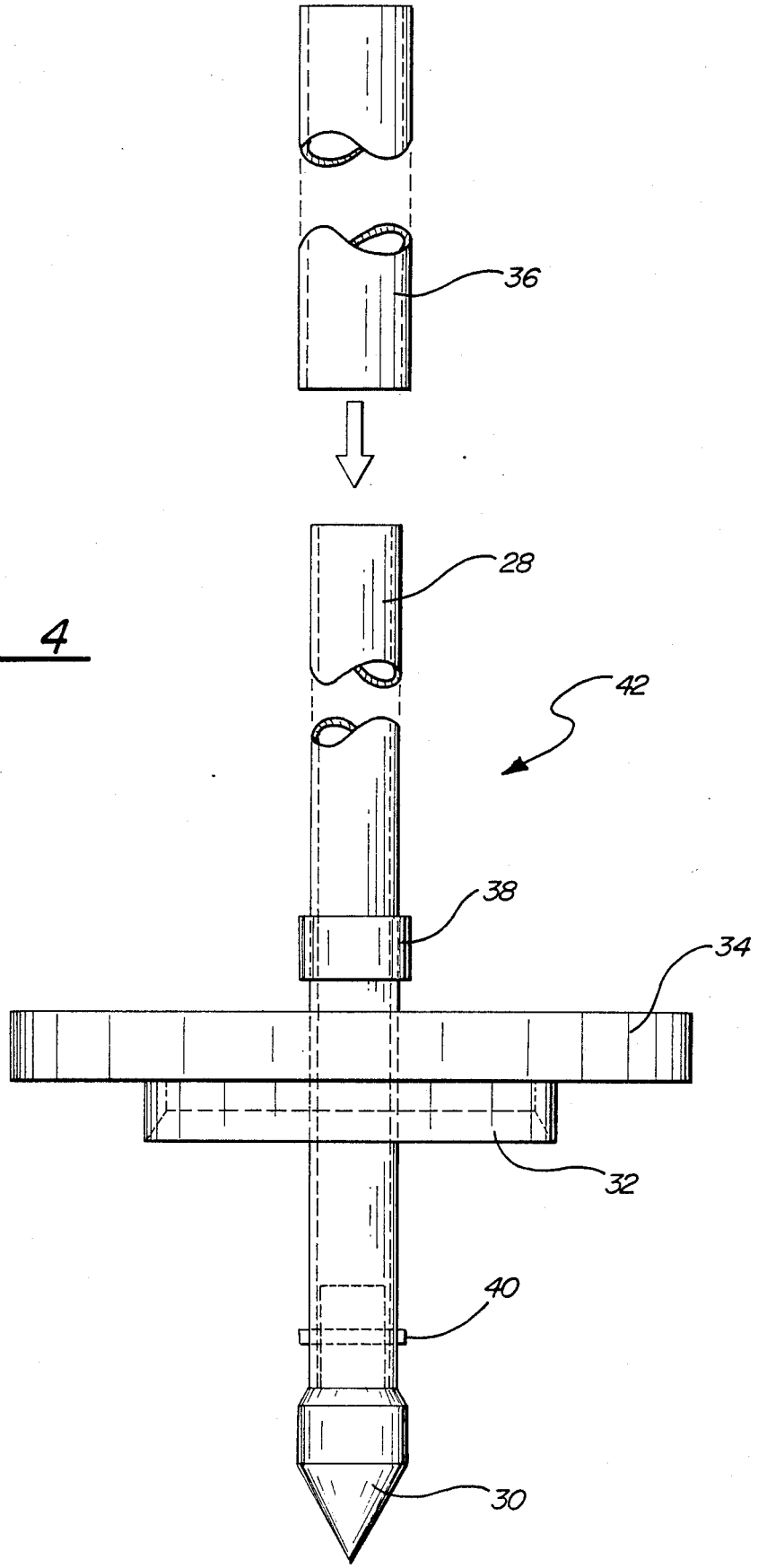
FIG. 4 is a side view of a hole maker useful in installing the device of FIGS. 1–3.

To install the receptacle in the ground, it is preferable to use a hole maker 42 of the type as shown in FIG. 4. The hole maker is a device comprising a four foot length of steel pipe 28. Attached to the steel pipe 28 by a roll pin 40, is a steel piercing point 30 which displaces the ground thereby creating a hole. A foot step plate 34 and cutting ring 32 are welded to the post 28 approximately 6 inches from the piercing point 30 so as to correspond to the length of the receptacle 12. The cutting ring 32 notches or scores the ground in order to facilitate solid placement of the surface plate 14. A loose-fitting sleeve 36 is attached over the post 28 which can be used as a driving mechanism upon the sleeve stop 38 to aid in driving the piercing point 30 into hard ground. The piercing point 30 is slightly larger in diameter than the post 28, allowing for ease of removal of the hole maker without widening the hole, thereby allowing a snug fit of the receptacle 12 when inserted into the hole.

The overall installation method is as follows. First a hole is formed using the hole maker 42 by driving the piercing point 30 into the ground approximately 6 inches, allowing the cutting ring 32 to score or notch the ground surface. The hole maker 42 is then removed. The receptacle 12 and surface 14 are then assembled. The receptacle 12 is inserted into the hole until the edge of the surface plate 14 is flush with the ground surface. The top of the receptacle 12 holds plate 14 in position, i.e., against the ground. The marker stake 10 is inserted into the hole.

Although a preferred embodiment of the present invention has been described in detail, various modifications, alterations and changes may be made without departing from the spirit and scope of the present invention as defined in the claims. For example, the swivel bearing of the disclosed embodiment "universal" in nature whereas a single axis swivel, although not preferred, could also be used.

I claim:

1. A boundary marking system of the type including a hollow, tubular receptacle of rigid weatherproof material having a longitudinal axis and adapted to be set in the ground with the upper open end at ground level, a weatherproof, essentially planar surface plate of substantially greater diameter than the receptacle disposed in surrounding relationship with the upper open end of the receptacle essentially at ground level, and a marker stake having a longitudinal axis parallel to the axis of the receptacle, removably disposed in the receptacle extending above ground level, wherein the improvement comprises:

swivel means interconnecting the receptacle and plate for varying the relative angular relationship between the plate and the axis of the receptacle so that the plate may lie flush with a non-level ground surface and nonperpendicular to said axis.

2. A device as defined in claim 1 wherein the upper surface of said plate is crowned.

3. A device as defined in claim 2 wherein the plate is disc shaped.

4. A device as defined in claim 3 wherein said swivel means includes a semi-spherical internal bearing seat formed centrally of said plate, and a corresponding semi-spherical external bearing seat formed on said receptacle adjacent the upper open end thereof.

5. A device as defined in claim 1 wherein the receptacle is beveled at the end opposite said upper end.

6. A device as defined in claim 5 wherein receptacle has a plurality of axially spaced annular barb rings formed on the exterior surface thereof to inhibit removal of the receptacle from the ground.

7. A device as defined in claim 6 wherein each annular barb ring has a beveled under surface and a planar top surface.

8. A device as defined in claim 1 wherein the marker stake is in the form of a hollow tube with open ends.

9. A device as defined in claim 8 further including a cap disposed on the top of .the marker stake.

10. A system as defined in claim 1 further including a hole maker device for use in installation of receptacles and plates comprising a post having a sharpened point, approximately the outside diameter of the receptacle and a cutting ring approximating the size of the plate.

11. A device as defined in claim 10 wherein a sleeve of larger diameter fits over the post and is used to exert axial force on the post to penetrate the ground surface.

12. A boundary marking system comprising:

a hollow tubular receptacle having a longitudinal axis;

a marker stake, having a longitudinal axis coaxially aligned with the longitudinal axis of the receptacle, removably and contiguously disposed in the receptacle;

a surface plate of substantially greater diameter than the receptacle; and a swivel means interconnecting the receptacle and surface plate for varying the relative angular relationship between the surface plate and the respective longitudinal axes of the receptacle and marker stake.

13. A device as defined in claim 12 wherein said swivel means includes a semi-spherical internal bearing seat formed centrally on said surface plate and a corresponding semispherical external bearing seat formed on said receptacle adjacent the upper open end thereof.

14. A device as defined in claim 13 wherein the receptacle has a plurality of axially spaced annular barb rings, each barb ring having a beveled under surface and a planar top surface, formed on the exterior surface of the receptacle to inhibit removal of the receptacle from the ground, said receptacle being further beveled at the end opposite said upper end.

15. A marker system as defined in claim 12 further including a hole maker device for use in the installation of the receptacles and surface plates comprising a post having a sharpened point, approximately the outside diameter of the receptacle and a cutting ring approximating the outside diameter of the surface plate.

16. A device as defined in claim 15 wherein a sleeve of larger diameter fits over the post and is used to exert axial force on the post to penetrate the ground surface.

17. A boundary marking system comprising:

a hollow tubular receptacle having a longitudinal axis, the receptacle further including a semi-spherical external bearing seat formed on the receptacle adjacent the upper open end thereof;

a marker stake having a longitudinal axis coaxial with the longitudinal axis of the receptacle, removably and contiguously disposed in the receptacle; and an essentially planar surface plate of substantially greater diameter than the receptacle, said surface plate further including a semi-spherical internal bearing seat formed centrally on said surface plate, said internal bearing seat coacting with the external bearing seat of the receptacle to vary the relative angular relationship between the surface plate and the coaxial longitudinal axes of the receptacle and marker stake.

* * * * *